US010260255B2

(12) United States Patent
Bunch et al.

(10) Patent No.: US 10,260,255 B2
(45) Date of Patent: Apr. 16, 2019

(54) DOUBLE LATCH HIGH SECURITY STRIKER BOX

(71) Applicant: Striker Box Door Security Products, LLC, Houston, TX (US)

(72) Inventors: Jowel Dee Bunch, Houston, TX (US); Harper S. Jones, Houston, TX (US)

(73) Assignee: Striker Box Door Security Products, LLC, Houston, TX (US)

( * ) Notice: Subject to any disclaimer, the term of this patent is extended or adjusted under 35 U.S.C. 154(b) by 36 days.

(21) Appl. No.: 15/351,574

(22) Filed: Nov. 15, 2016

(65) Prior Publication Data

US 2017/0058562 A1 Mar. 2, 2017

Related U.S. Application Data

(63) Continuation-in-part of application No. 14/524,722, filed on Oct. 27, 2014, now Pat. No. 9,556,647.

(51) Int. Cl.
*E05B 15/02* (2006.01)
*E05B 17/20* (2006.01)

(52) U.S. Cl.
CPC ..... *E05B 15/0205* (2013.01); *E05B 17/2084* (2013.01)

(58) Field of Classification Search
CPC .... E05B 15/024; E05B 15/025; E05B 15/029; E05B 17/2084; E05B 2015/0215
See application file for complete search history.

(56) References Cited

U.S. PATENT DOCUMENTS 1,479,371 A * 1/1924 Moskowitz ..... E05B 15/0205 292/340
4,105,235 A * 8/1978 Thiel ..... E05B 15/0245 292/341.18
4,113,293 A * 9/1978 Paquette ..... E05B 15/025 292/341.18
4,130,311 A * 12/1978 Sushan ..... E05B 17/2003 292/346
4,195,870 A * 4/1980 Percoco ..... E05B 15/0205 292/340
6,834,897 B1 * 12/2004 Walker ..... E05B 15/0205 292/340
D531,485 S * 11/2006 Cutler ..... D8/343
9,556,647 B2 * 1/2017 Bunch ..... E05B 15/0205
2005/0127692 A1 * 6/2005 Sanders ..... E05B 15/0245 292/340
2007/0096480 A1 * 5/2007 Arneson ..... E05B 15/0205 292/340
2010/0201138 A1 * 8/2010 Sauder ..... E05B 15/0245 292/340

(Continued)

*Primary Examiner* — Mark A Williams

(57) ABSTRACT

A striker box assembly provides enhanced security when locking a door where the assembly includes two boxes and one common cover plate attached to the two boxes where each box is associated with a latch from a locking device. The combination of the two boxes and common cover plate make the assembly stronger where a deadbolt and doorknob lockset are both locked, but if the latch in the doorknob lockset itself breaks while the box associated with that latch is still firmly attached to a stud, that box continues to resist the breaching of the door through the common cover plate reinforcing the box associated with the deadbolt.

16 Claims, 5 Drawing Sheets

(56) References Cited

U.S. PATENT DOCUMENTS

| | | | | |
|---|---|---|---|---|
| 2012/0056439 | A1* | 3/2012 | Stendal | E05B 15/0205 292/340 |
| 2016/0115710 | A1* | 4/2016 | Bunch | E05B 15/0205 292/340 |

* cited by examiner

DOUBLE LATCH HIGH SECURITY STRIKER BOX

CROSS-REFERENCE TO RELATED APPLICATIONS

This application is a continuation-in-part application which claims benefit under 35 USC § 120 to U.S. application Ser. No. 14/524,722 filed Oct. 27, 2014, entitled "High Security Striker Box", and that application is incorporated herein in its entirety.

STATEMENT REGARDING FEDERALLY SPONSORED RESEARCH OR DEVELOPMENT

None.

FIELD OF THE INVENTION

This invention relates to strikes or striker plates used for locking doors. A strike or striker plate is typically installed in the jamb of a door to receive a bolt latch of a lock such as a deadbolt so that together, they securely hold the door closed.

BACKGROUND OF THE INVENTION

To securely lock a door, one needs or wants a strong door, a strong door frame, a strong latch and a strong strike or striker plate. Like a chain, the combined strength of the locked door is limited by the strength of the weakest of the elements.

Focusing on the strike or striker plate, at an outside door to be securely locked, it is common to have a strong striker plate comprised of steel that is screwed into and maybe through the door jamb into the underlying supporting structure. One might use extra-long screws to hold the striker plate not just to the jamb, but also to a 2×4 stud behind the jamb that is part of the structure of the wall. However, even thicker steel striker plates with extra-long screws may be quickly defeated by a motivated thief that is able to apply a powerful kick to the door near the lock and the striker plate. The screws may hold firm to the 2×4 stud, but the striker plate is typically spaced about an inch from the 2×4 stud. The screws may have a lot of tensile strength, but they do bend. With the screws extending an inch out from the stud, such impacts from kicking the door may bend the screws sufficiently to allow the striker plate to pivot inwardly so that the latch may slip out of the hole in the striker plate. The bending screws also are levers to break apart the jamb and the 2×4 studs, which is a second mode of failure of the striker plate. Regardless of the strength of the door and the strength of the latch, if the striker plate fails, the doorway may be breached based on the failure of the simplest and smallest element for an outside security door.

While stronger materials are being continually developed, there is a need for a simple, but effective strike or striker plate to work with stronger doors and stronger latches to provide better security for people and things. There is a need for an improved design for a striker plate to take better advantage of the underlying structure of a doorway opening.

BRIEF SUMMARY OF THE DISCLOSURE

The invention relates to a striker box assembly comprising first and second boxes that are each formed of four connected lateral walls. A first lateral wall is an inner wall, a second lateral wall is a back wall that is opposite the inner wall, a third lateral wall is an upper wall and the fourth of the four lateral walls is a lower wall, and these four lateral walls of each box are connected end to end to form a generally rectangular shape. Each box also has an open front and a boot flange opposite the open front and attached to at least three of the four connected lateral walls at a bottom of the box and arranged generally perpendicular to all four lateral walls. At least one primary screw hole is located in the boot flange of each box and is suited to receive a primary screw to hold the box to a stud in a wall adjacent the door jamb when the boxes are installed, one above the other, in the door jamb. The first and second boxes each further include a jack flange attached at or near the bottom of the inner wall that is arranged to extend away from the open front of the box beyond the boot flange of the box. Additionally, at least one jack screw hole is located in each jack flange that is suited to receive a jack screw through the jack screw hole in each jack flange and into the stud in the wall adjacent the door jamb to hold the jack flange to the stud when the boxes are installed one above the other in the door jamb. The primary screw hole and the jack screw hole each have an axis, and the axis of the primary screw hole is generally perpendicular to the axis of the jack screw hole. Each box further includes an upper wing that is attached to the upper wall at or near the open front of the box and is arranged to extend away from the lower wall. Similarly, each box includes a lower wing attached to the lower wall at or near the open front of the box and arranged to extend away from the upper wall and away from the upper wing. The wings are generally arranged to be in a common plane that is spaced apart and generally parallel to the boot flange and the plane of the wings of both boxes are intended to be in a generally common plane when the boxes are installed in the door jamb. The assembly further includes a cover plate for being attached to the wings of both boxes wherein the cover plate comprises a face plate and a back flange wherein the face plate comprises two spaced apart latch holes that, when installed to a door jamb, are each arranged to receive a latch of a door locking system and wherein each latch hole is arranged to overly an open face of one of the boxes installed in the door jamb. The face plate is generally flat and, when installed to a door jamb, lies in a plane that is generally flush on the wings of the boxes such that the latches of the door locking system may enter into their respective hole in the face plate and into the respective box such that the boxes and cover plate together resist against lateral movement of the latches which would occur when the door is to be opened. The assembly further includes at least one support screw attached to each boot flange of the two boxes where the support screws have a blunt end for being positioned flush against a stud or structural element within wall at the frame of a door in which the box is suited for installation. Thus, by the combination of the boxes with the support screws and cover plate, the assembly is suited to be installed in a door frame and, when installed, is very securely attached to the stud or structural element by screws oriented generally perpendicular to one another within the wall at the doorframe and strongly resist force and impacts that are intended to breach the door when closed and locked.

The invention further relates to an installed striker box assembly for providing a stronger, more secure striker for a latch of a door locking system wherein the assembly includes a jack stud in a wall defining one side of a rough door opening and a door jamb arranged generally along the jack stud wherein the door jamb defines a finished door opening within the rough door opening. A first box is installed in the door jamb at a position to receive a latch from a deadbolt lock and a second box is installed in the door jamb at a position to receive a latch from a doorknob lockset wherein the second box is also positioned in said door jamb and spaced below the first box. Each of the first and second boxes comprise four connected lateral walls where a first lateral wall is an inner wall, a second lateral wall is a back wall that is opposite the inner wall, a third lateral wall is an upper wall and the fourth of the four lateral walls is a lower wall, and wherein the four lateral walls of each box are connected end to end to form a generally rectangular shape. Each box further has an open front oriented toward the respective latches of the deadbolt and doorknob lockset and also has a boot flange opposite the open front and attached to at least three of the four connected lateral walls at a bottom of each box and arranged generally perpendicular to all four lateral walls and also oriented toward the jack stud and arranged to have firm contact indirectly with the jack stud. The assembly includes at least one primary screw hole located in the boot flange of each box along with a primary screw extending through each of the primary screw holes and into the jack stud to hold the respective box to the jack stud. Each box further includes a jack flange attached at or near the bottom of the inner wall and arranged to extend away from the open front of each box beyond the back flange of the box and be positioned flush against the jack stud. The jack flange includes at least one jack screw hole with a jack screw extending through each jack screw hole and into the jack stud holding the jack flange against the jack stud. With this arrangement, the primary screw hole and jack screw hole are also arranged to be generally perpendicular to one another. Each box further includes an upper wing attached to the respective upper wall at or near the open front of the box and arranged to extend away from the lower wall and similarly includes a lower wing attached to the lower wall at or near the open front of the box and arranged to extend away from the upper wall and away from the upper wing, wherein the wings are generally arranged to be in a common plane that is generally parallel to the boot flange. The assembly further includes a cover plate attached to the wings of both boxes wherein the cover plate comprises a face plate and a back flange wherein the face plate includes two spaced apart latch holes wherein a first latch hole is arranged to overly the open front of the first box and a second latch hole is arranged to overly the open front of the second box such that the respective latches of the deadbolt and the doorknob lockset extend through the respective latch holes and into the respective boxes and such that both boxes and the cover plate resist against lateral movement of the latches. The assembly also includes at least one support screw attached to each boot flange of the two boxes where the support screw has a blunt end for being positioned flush against the jack stud to both hold each box away from the jack stud a desired distance so the boxes and cover plate are desirably positioned flush with the door jamb and also so that any force applied to the boxes will be resisted by the support screws in contact with the jack stud. Machine screws are included to hold the cover plate to the boxes, and at least two secondary screws holding the cover plate to the boxes and firmly to the jack stud. The assembly, with the combination of the boxes with the support screws and the cover plate installed in the door jamb in contact with the jack stud and screwed to the jack stud using screws that are oriented in at least two generally perpendicular directions is very securely attached to the jack stud and strongly resists force and impacts that are intended to breach the door when closed and locked.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
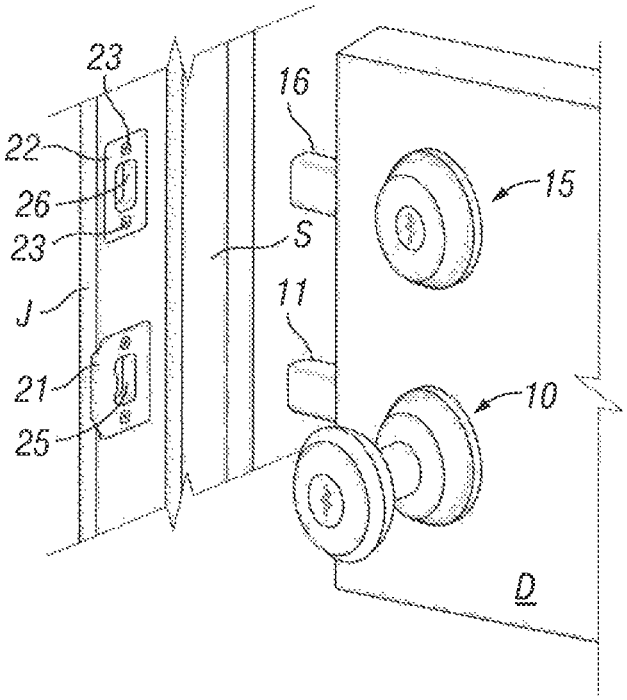
FIG. 1 (Prior Art)
FIG. 1 is a perspective view of a door having a door knob and a deadbolt lock each of which are arranged to latch into conventional prior art striker plates.

Turning now to FIG. 1, a conventional door D is shown that swings closed to a door jamb J and stops against door stop S. Once closed, a spring latch 11 engages a strike or striker plate 21 attached to the jamb by descending into the opening 25 in the striker plate 21. The door D may be re-opened by turning the knob 10 to pull the spring latch 11 from the striker plate 21. However, to securely lock the door D, a deadbolt 15 having a bolt latch 16 engages striker plate 22 by descending into opening 26 in the striker plate 22. The bolt latch may be hardened steel and the deadbolt is designed to prevent the withdrawal of the bolt latch 16 unless the cylinder is properly engaged by a key or the inside thumb switch (neither of which is shown).

Figure 2:
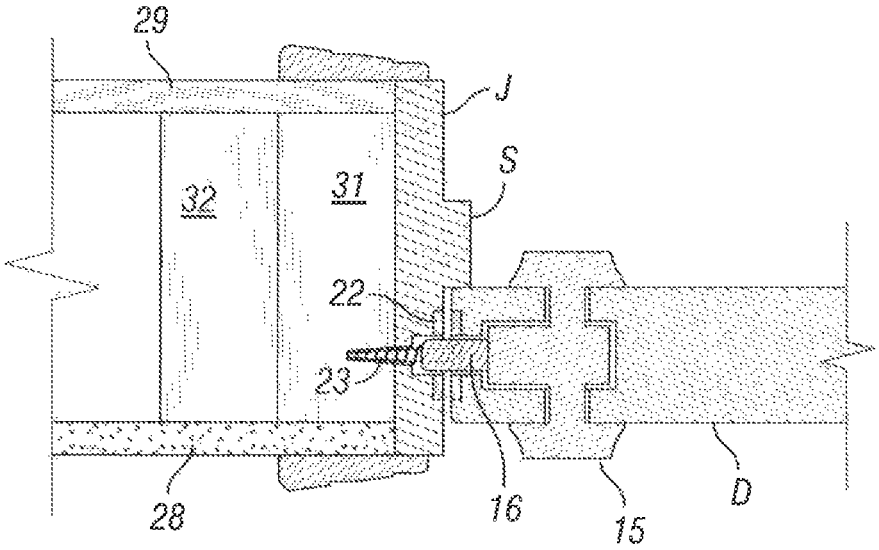
FIG. 2 (Prior Art)
FIG. 2 is a top sectional view of the door closed with the latch of the deadbolt extended into and engaged with the conventional striker plate in the door jamb while the door is closed against the door stop.
Figure 3:
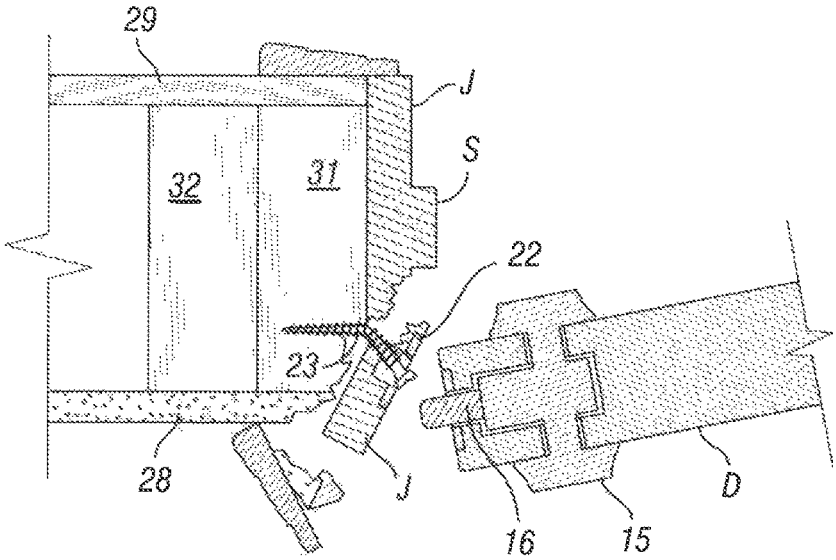
FIG. 3 (Prior Art)
FIG. 3 is a second top cross sectional view showing the failure of a conventional striker plate when the door has been kicked open.

Referring to FIG. 2, the bolt latch 16 is shown fully extended into the opening 26 in the striker plate 22 to resist opening of the door. As shown in FIG. 3, if a powerful force is applied from the outside of the inwardly swinging door D, such as from a person kicking or charging the door or by some type of battering ram, the screws 23 holding the striker plate to the jamb J and perhaps the jack stud 31 tend to bend inwardly. Eventually, the jamb J breaks and the bolt latch 16 pops loose from the striker plate 22 as the striker plate rolls away from the door stop S. The length that the screws extend out from the jack stud 31 to the striker plate 22 also tends to give leverage to the forces being applied to the striker plate and tears up the jamb J and the jack stud 31, especially if the screws 23 are installed close to the edge or inside lateral face of the stud 31.

It should be noted that most conventional doors are framed with jack studs on either side of the opening with a header spanning across the top of the rough opening. The jack studs 31 are installed flush against king studs 32 which extend fully to the top plate.

FIGS. 1-3 are prior art arrangements.

Turning now to the present invention which is a double latch striker box assembly and shown in FIGS. 4-12 comprising a single cover plate 40 arranged to accommodate two latches, one of a top deadbolt with a first box 50 and the second latch from a doorknob lockset at a second box 150. The boxes 50 and 150 are essentially identical, but are installed to catch the latch pins from the deadbolt and the doorknob lockset generally as shown in FIG. 1 and hold the door closed until the resident decides that the door should be open. One of the features of this present invention is that the single cover plate 40 works in conjunction with the first box 50 and the second box 150 to better resist a beating inflicted on the door by utilizing the combined strengths of all three elements together along with additional screws extending at least into the adjacent stud in the wall, but better yet, into both of two adjacent studs in the wall. This joint and combined strength will become better understood as the explanation of the invention progresses.

The central elements of the composite striker system or assembly are the two boxes 50 and 150 which should be made of strong and robust material. It would be expected that these boxes 50 and 150 would be made of steel and that the walls would have a robust dimension. For example, the thickness of the walls might be between about 1/32" and about 3/16" steel depending on the security desired for the door D.

Each of the boxes 50 and 150 includes four connected lateral walls. Box 50 is shown to be comprised of lateral walls 61, 52, 54 and 55. The first lateral wall 61 is also an inner wall 61. A second lateral wall 53 is also a back wall 52 that is opposite the inner wall 61. A third lateral wall 54 is also an upper wall 54 and the fourth lateral wall 55 of the four lateral walls is a lower wall 55. The four lateral walls are connected end to end to form a rectangular shape. The boxes 50 and 150 have an open front or top and a bottom wall 58 (sometimes called a boot flange) that is arranged to at least partially close the bottom of the box 50 or that side of the box facing the jack stud 31. The bottom wall or boot flange 58 may optionally extend fully across that bottom of the box so that it is fully closed on five sides and open on the front or top. In the preferred embodiment, it is only partially closed on the bottom leaving an open gap or pass through along the first lateral wall 61. The bottom wall 58 is also called the boot flange 58 and is arranged generally perpendicular to the four lateral walls 61, 52, 54 and 55.

The back wall 52, the upper wall 54 and lower wall 55 all have a common depth dimension when considering the dimension from the front or top of the box 50 to the bottom. However, inner wall 61 includes a portion that extends beyond the bottom wall 58. This extended portion may be called a jack flange. It may be viewed by some that it is not clear where the inner wall 61 ends and the jack flange begins, but it may be viewed or understood that the jack flange begins about where the plane of the bottom wall or boot flange 58 intersects the inner wall 61. The function of the jack flange 61 will be explained below.

Each box 50 and 150 further includes an upper wing 62 attached to the upper wall 54 and which extends generally flush with the open top of the box 50 and generally perpendicular to the upper wall 54. Similarly, a lower wing 63 is attached to the lower wall 55 and which extends generally flush with the open top of the box and generally perpendicular to the lower wall 55. It should be noted that these wings 62 and 63 extend away from the interior of the box.

Each box 50 and 150 further includes a base wing 65 that is somewhat similar to the upper and lower wings 62 and 63, but attaches to the inner wall 61 and which extends generally flush with and away from open front of the box 50 and generally perpendicular to the inner wall 61. Preferably, the three wings 62, 63 and 65 generally lie in a common plane.

Each box 50 and 150 includes at least one primary screw hole 94 and at least one, but preferably two threaded support screw holes 77 located in the bottom wall or boot flange 58. Each box further includes a pair of threaded assembly holes 74 in the base wing 65 and at least one secondary box hole 75 in each of the top and bottom wings 62 and 63.

Figure 4:
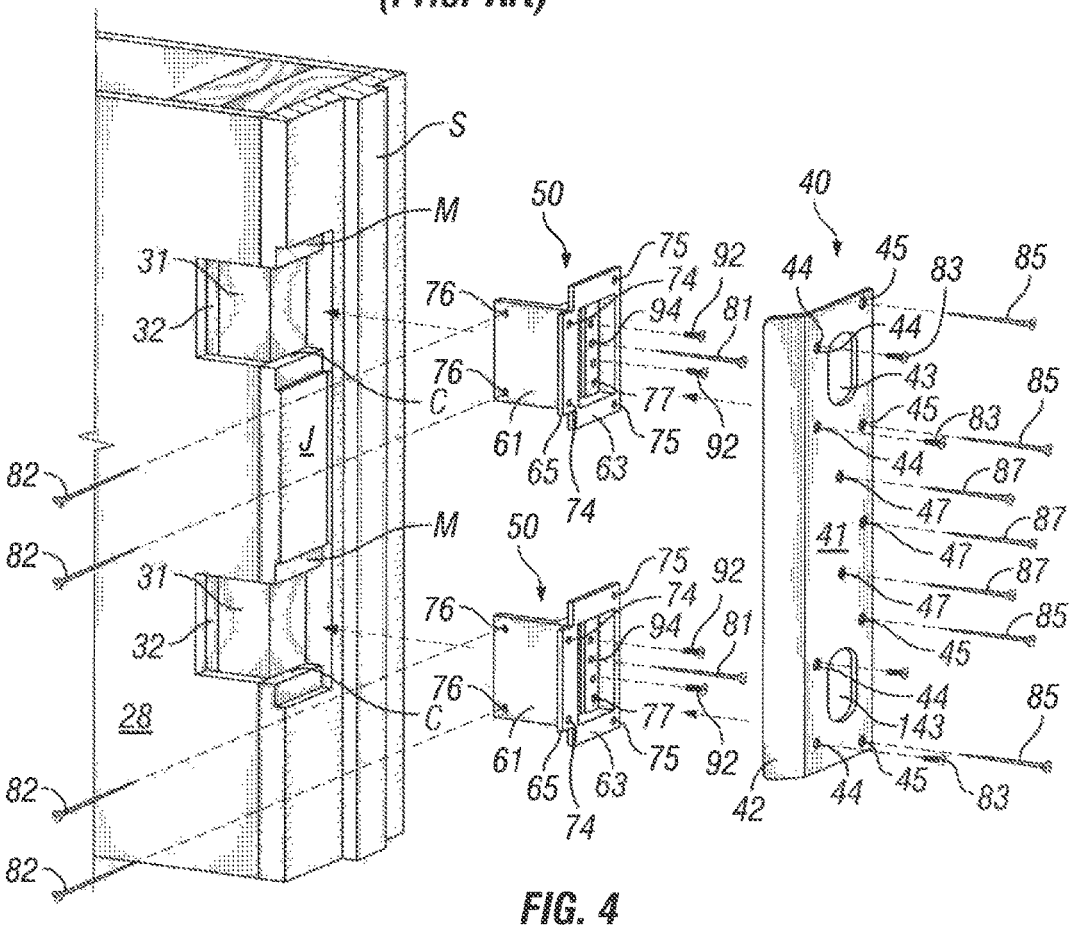
FIG. 4 is an exploded view of the inventions showing two striker boxes with the single cover plate all shown to be installed into a door jamb.
Figure 5:
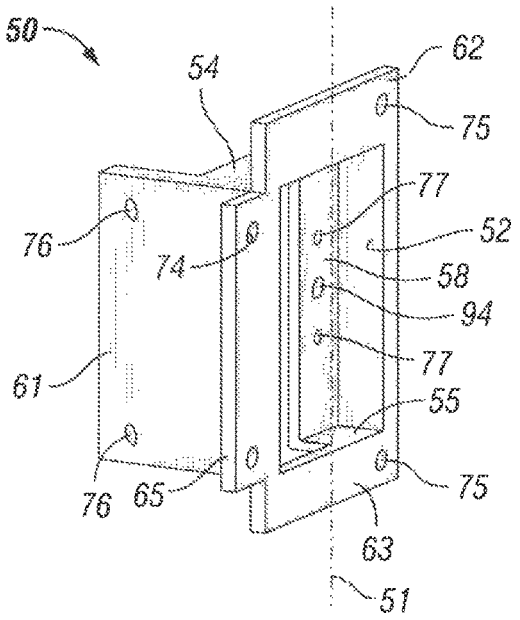
FIG. 5 is a perspective view of a single box according to the present invention.

Looking back at FIG. 4, the cover plate 40 includes a face plate 41 and a back flange 42. The face plate 41 is arranged to cover the open top or front of the boxes 50 and 150 and includes two main openings or latch holes indicated at 43 and 143 that are aligned with the open faces of boxes 50 and 150. Commonly the main openings or latch holes 43 and 143 are preferably 5.5 inches apart, which is the convention or standard in the United States, but may be a different spacing elsewhere. The face plate 41 further includes four inner screw holes 44 and four back screw holes 45 each generally surrounding the openings 43 and 143. The inner screw holes 44 are arranged to align with threaded assembly holes 74 in the base wing 65 and the back screw holes 75 in the face plate are arranged to along with the secondary box holes in the top and bottom wings 63 and 65, such that when the boxes and cover plate are installed into the jamb of the door opening, the screw holes 74 and 75 in the cover plate 40 are arranged to align with the screw holes 44 and 45, respectively, in the boxes 50 and 150. The cover plate 40 is attached to the boxes 50 and 150 by machine screws 83 extending through inner screw holes 44 and into threaded assembly holes 74. The boxes 50 and 150 are sandwiched between the cover plate and the jamb J by secondary screws 85 that extend through the back screw holes 45, the secondary box holes 75, the jamb J and into the jack stud 31 and preferably through the jack stud 31 and into the king stud 32. Inner screw holes 44, back screw holes 45 and secondary box holes 75 do not have screw threads. Cover plate 41 further includes at least one tertiary hole 47 between the openings 43 and 143 for a tertiary screw 87 to further secure the cover plate 41 in place and to the studs 31 and 32. Ideally, it there are several tertiary holes 47, they will not all be along the same vertical line with the back screw holes 45 so that the secondary screws 85 and tertiary screws 87 will not likely all be in the same grain line of the wood of the studs 31 and 32, but would enter multiple grain lines.

Still focusing on FIG. 4, prior to installation of the striker box assembly, two portions of the door jamb J are cutout exposing the jack stud 31 along with a thinner portion between those cutouts so that the full vertical length of the cover plate 41 is arranged to be flush with the face of the jamb J. Similar cutouts are made in the drywall 28 exposing the side or lateral face of the jack stud 31 and possibly part of the king stud 32. Into these cutouts, the box 50 and second box 150 are positioned for installation. Typically, a surface portion of the door jamb J would also be removed with a chisel by mortising a recess M both above and below the cutouts C to let the upper and lower wings 62 and 63 recess below the face surface of the door jamb J at a sufficient depth so that the cover plate 40 ends up generally flush with the same face surface of the door jamb J.

Figure 11:
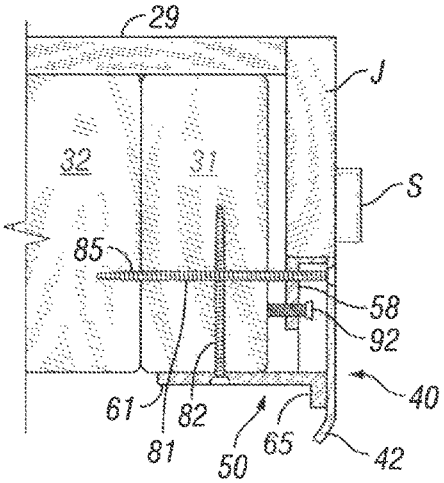
FIG. 11 is a top cross sectional view of the striker assembly showing how the face plate and box fit together to strengthen each other and resisting bending forces applied when the door is being kicked or impacted.
Figure 12:
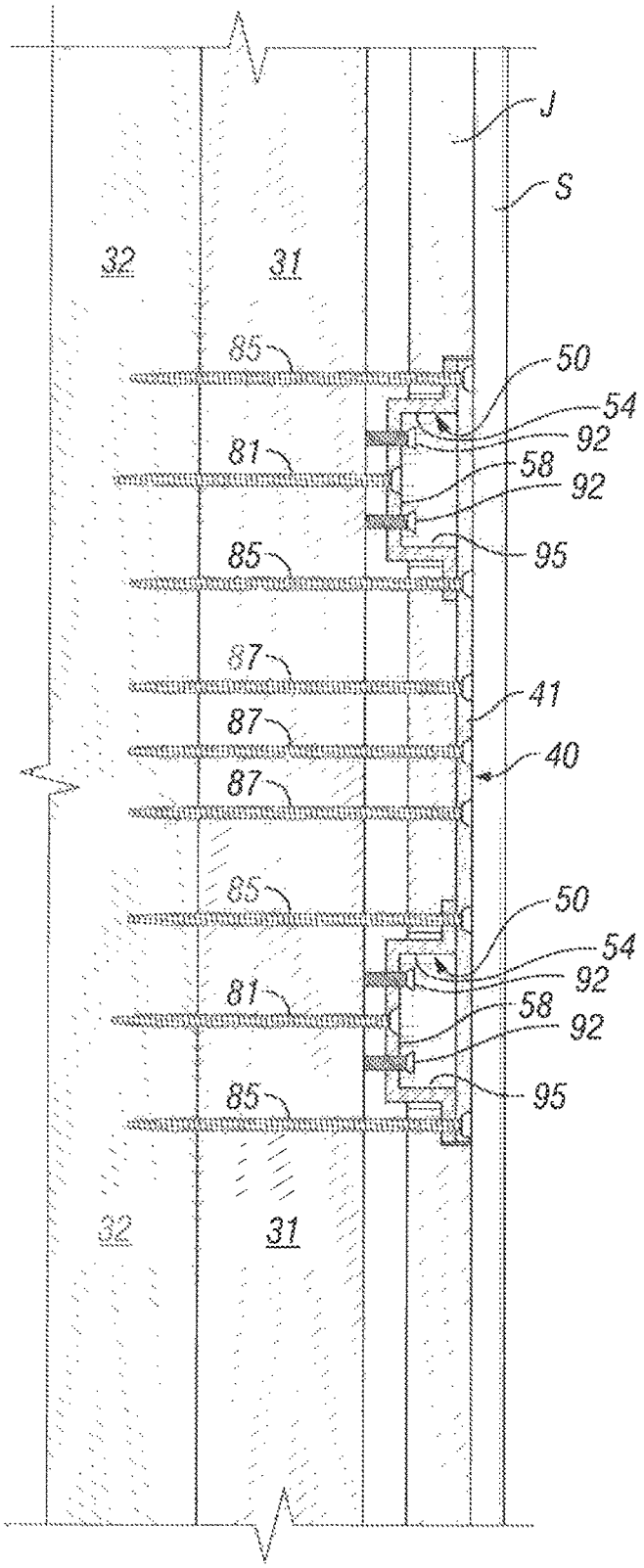
FIG. 12 is a side cross sectional view showing the box and cover plate installed in the jamb and spaced from the stud, but where the box and cover plate are installed firmly to the stud using multiple screws securing both the base of the box to the stud and the top plate tightly to the stud.

Turning to FIG. 11, one of the key features of the present invention is the combination of support screws 92 positioned in threaded support screw holes 77 with the blunt ends of the support screws arranged firmly against the jack stud 31. The support screws 92 maintain the bottom wall or boot flange 58 of each box, and in effect, each entire box 50 and 150 spaced from the jack stud 31. That spacing may be adjusted by adjusting the depth of the support screws 92 in threaded support screw holes 77. While support screws 92 are effectively pushing away from jack stud 31, a primary screw 81 is arranged to hold the bottom wall or boot flange 58 to the jack stud 31 and also preferably to the king stud 32. So, even though each of the boxes 50 and 150 are not up flush against the jack stud 31, the boxes 50 and 150 are very strongly and stably attached to the jack stud 31 and through the jack stud 31 to the king stud 32, but in a position that best seals and secures the door in the jamb when closed. The attachment of the striker box assembly is further supported by the secondary screws 85 and the at least one tertiary screw 87 noting that the secondary screws 85 and the tertiary screw 87 are further tightly holding the cover plate 40, the boxes 50 and 150 to the jack stud 31 and the king stud 32 in a relatively tight sandwich. With the support screws 92 properly set to space the bottom wall or boot flange 58 from the jack stud 31, the jamb J and cover plate 40 is preferably positioned so that the door D is able to close, but in close proximity to the jamb for any weather seal to properly and effectively function and also so that the latch from a deadbolt or doorknob are able to extend as far into the respective boxes 50 and 150 for the latches 11 and 16 to best set into the boxes 50 and 150 and openings 43 and 143 in the cover plate 40 to most strongly hold the door D closed while locked by the deadbolt 15 and doorknob lockset 10.

As shown in FIG. 4, the boxes 50 and 150 would first have the respective support screws 92 installed and then each be attached to the jack stud 31 by primary screws 81 through respective screw holes 94. The attachment of the box 50 to the jack stud 31 is supposed to arrange the door jamb J so as to be spaced somewhat from the jack stud 31 to make the door jamb J square, straight and vertical. Also, the frame for the door (which includes door jamb J) is typically slightly smaller than the rough opening in the wall for the door where the rough opening is defined by a pair of jack studs (one on the latch side of the opening and the other on the hinge side of the opening) and a header (not shown). Centering the frame and the door in the rough opening creates space between the door jamb J and the jack stud 31. Typically, shims are positioned at several vertical locations between the jamb J to the jack stud 31 where nails or screws attach the jamb J to the rough opening through those several shims. In the present invention as shown in support screws 92 fill the space between the bottom wall 58 and the jack stud 31 at that specific vertical elevation providing firm support to the box 50 and the striker assembly from the jack stud 31. A shim is a thin wedge typically made of wood, but may be plastic or metal.

For all the embodiments, a set of jack screws 82 are used to attach the inner wall or jack flange 61 of each of the boxes 50 and 150 to the jack stud 31 via screw holes 76. It should be noted that jack screws 82 are oriented generally perpendicular to the primary screw 81, the secondary screws 85 and the tertiary screw 87. Having the jack screw arranged at such a strongly divergent angle from the primary, secondary and tertiary screws makes it so that only one screw is always oriented in a strong orientation to resist failure under a destructive load while the other screw may be in a less strong orientation to resist failing. For example, if a fully inserted screw is weakest in pure tension, then if the boxes 50 and 150 were each being pulled straight out from the door jamb J, jack screw 82 would strongly resist that load and tend to provide support for primary screw 81 preventing the primary screw 81 from failing. So, a load imposed on the door D oriented to push the box 50 inwardly into the room in which the door D would swing when opened, the jack screws 82 would be in tension and the primary screws 81 would be in an orientation to the load that would be better able to provide the additional resistance to this type of load or force. Moreover, the jack screws 82 also create a different hinge point resisting failure of the striker box assembly compared to the failure shown in FIG. 3. The jack screws 82 would resist the collapse of the inside edge of the boxes 50 and 150 such that as the door D was forced open, the boxes 50 and 150 would be forced to slide with the door D. However, the primary screw 81 along with the secondary screws 85 and tertiary screw 87 would strongly resist such sliding with the door. Clearly, there is a force that may be imposed on the door D that would overcome the strength of the weakest link of the door, the locks and latches, and the striker box assembly. But with the jack screws 82 at their position and orientation, that overpowering force would have to be higher for the striker box assembly to fail as compared to conventional strike plates shown in FIGS. 2 and 3. In other words, with the boxes 50 and 150 secured by a jack flange 61 to the side of the jack stud 31, the box 50 is better prevented from rolling or rotating in the cutout while the door D is being forced open.

After the boxes 50 and 150 are attached to the jack stud 31 by primary screws 81 and jack screws 82, cover plate 40 is attached to the boxes by machine screws 83. A third way of attaching the boxes 50 and 150 along with the cover plate 40 to the jack stud 31 is with secondary screws 85 that extend through screw holes 45 in the cover plate 40 and screw holes 75 in the box 50 and then through the jack stud 31 and into king stud 32. The screw holes 45 and 75 align such that the screws 85 hold the cover plate 40 and the box 50 together while attaching to the jack stud 31 and king stud 32. It should be noted that the screw holes 75 are off center relative to the box 50 (as identified by centerline 51 in FIGS. 5 and 6) and especially with respect to the main openings 43 and 143 in the cover plate 40 so that the secondary screws 85 will be positioned closer to the center of the jack stud 31 and further away from the edge of the jack stud 31 to avoid the vulnerability of tearing up the jack stud as described above when discussing FIGS. 2 and 3 above. Moreover, tertiary screw 87 is arranged to secure the cover plate 40 to the jack stud 31 between the boxes 50 and 150 providing more resistance to an impact load on the door and onto the striker assembly.

Figure 6:
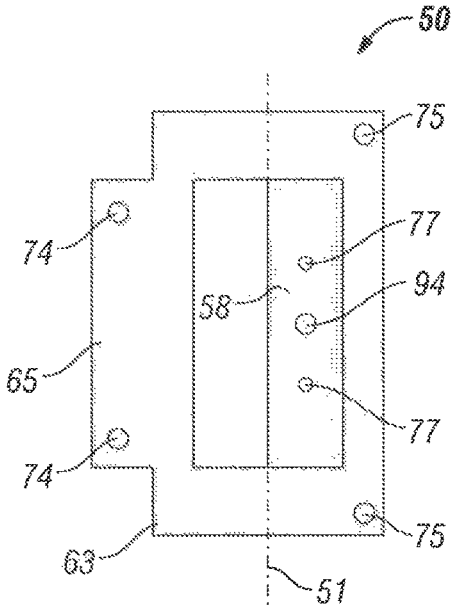
FIG. 6 is front view of a single box of the present invention.
Figure 7:
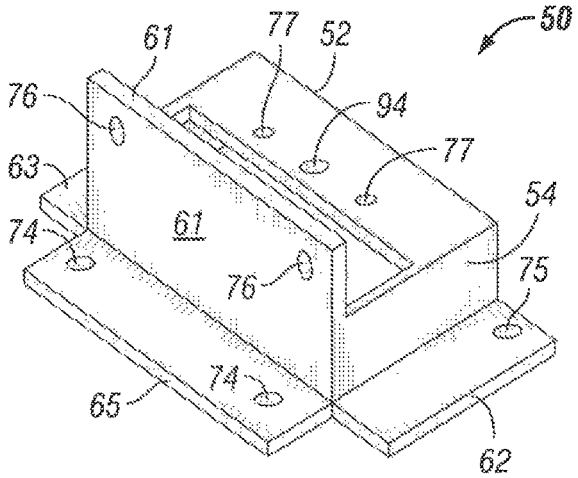
FIG. 7 is a bottom perspective view of a single box providing an alternative angle to better understand the structure of the box.
Figure 8:
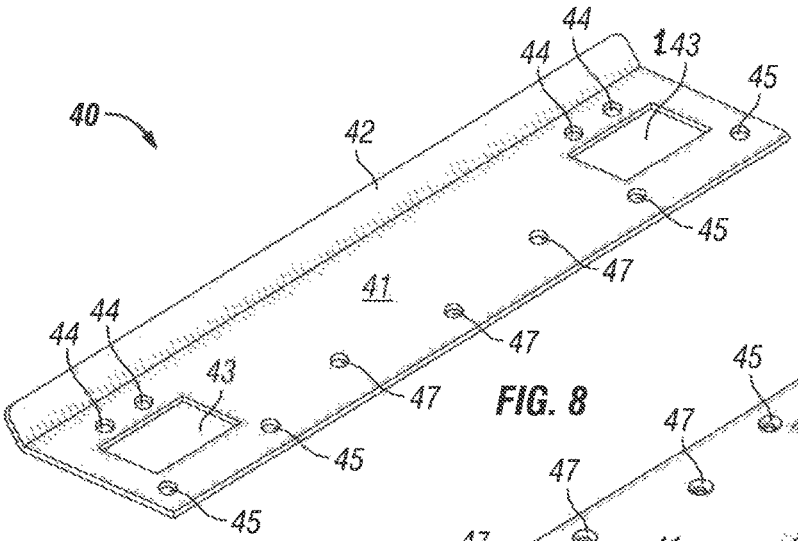
FIG. 8 is a bottom perspective view of the cover plate suited for two boxes.
Figure 9:
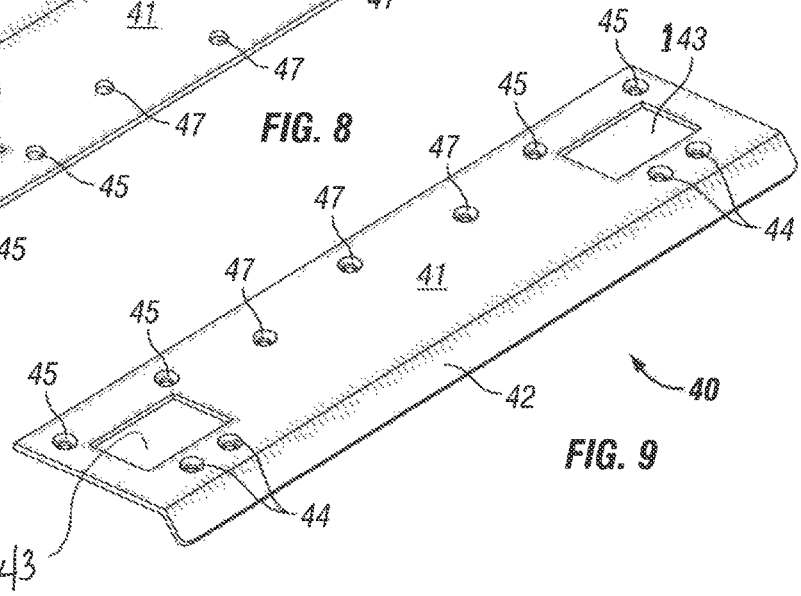
FIG. 9 is a top perspective view of the cover plate suited for two boxes.

Focusing on FIG. 6, the center line 51 is shown extending vertically across the face or front opening of the box 50 and the holes 75 are positioned on the opposite side of the centerline from the jack flange 61 and closer to the inner wall 52. It should also be noted that the center bore 98 is arranged to be outside the alignment of the screw holes 75 and 77 to reduce the probability that all three screws will hit the same grain line in the wood. If all three screws hit the same grain line, the stud would be likely to split and be seriously weakened.

Figure 10:
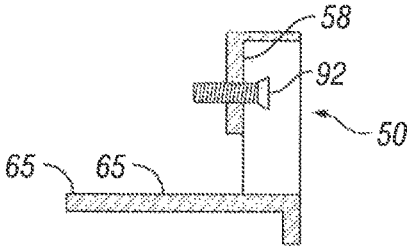
FIG. 10 is a top cross sectional view of a box showing the support screws for holding the box away from the stud.

One feature of the invention that provides additional strength to the striker box assembly is the way the inner wall 61, the base wing 65 and the back flange 42 are arranged to create a U-channel as seen in FIG. 10. This U-channel provides resistance to distortion of the striker box assembly under a severe load in a manner similar to the way an I-beam or a piece of channel iron resists bending.

Another aspect of the striker box assembly is that the support screws 92 are arranged to be offset from where the latch 16 may set into the box 50. The box 50 is generally preferred to be about ⅝" in depth to work with a conventional jamb dimension of 11/16".

When the drywall 28 and door trim 99 are attached, the striker box assembly will appear to be reasonably similar to conventional systems and the cutouts will not be visible.

Ultimately, the striker box assembly will only be as strong as the materials from which it is constructed and to which it is attached. This invention is intended to take as much advantage of the available structure within the wall surrounding the door as possible in a cost considered manner and reduce the likelihood of failure of the door system based on the striker being the weak link.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A striker box assembly for providing a strong, secure striker for a latch of a door locking system when installed in a door jamb, the assembly comprising:

a first and second separate boxes that each comprise four connected lateral walls where a first lateral wall is an inner wall, a second lateral wall is a back wall that is opposite the inner wall, a third lateral wall is an upper wall and the fourth of the four lateral walls is a lower wall, wherein the four lateral walls of each box are connected end to end to form a generally rectangular shape, each box further having an open front and a boot flange opposite the open front and attached to at least three of the four connected lateral walls at a bottom of the box and arranged generally perpendicular to all four lateral walls, at least one primary screw hole located in the boot flange of each box and suited to receive a primary screw through the primary screw hole to hold the box to a stud in a wall adjacent the door jamb when the boxes are installed one above the other in the door jamb, the first and second boxes each further include a jack flange attached at or near the bottom of the inner wall and arranged to extend away from the open front of the box beyond the boot flange of the box, at least one jack screw hole located in each jack flange suited to receive a jack screw through the jack screw hole in each jack flange and into the stud in the wall adjacent the door jamb to hold the jack flange to the stud when the boxes are installed one above the other in the door jamb, wherein each of the primary screw hole and the jack screw hole have an axis and the axis of the primary screw hole is generally perpendicular to the axis of the jack screw hole, the box further including an upper wing that is attached to the upper wall at or near the open front of the box and arranged to extend away from the lower wall, a lower wing attached to the lower wall at or near the open front of the box and arranged to extend away from the upper wall and away from the upper wing, wherein the wings are generally arranged to be in a common plane that is spaced apart and generally parallel to the boot flange and the plane of the wings of both boxes are intended to be in a generally common plane when the boxes are installed in the doorjamb;

a cover plate for being attached to the wings of both boxes wherein the cover plate comprises a face plate and a back flange wherein the face plate comprises two spaced apart latch holes that, when installed to a door jamb, are each arranged to receive a latch of a door locking system wherein each latch hole is arranged to overly an open face of one of the boxes installed in the door jamb, and further wherein the face plate is generally flat and, when installed to a door jamb, lies in a plane that is generally flush on the wings of the boxes such that the latches of the door locking system may enter into their respective hole in the face plate and into the respective box such that the boxes and cover plate together resist against lateral movement of the latches which would occur when the door is to be opened; and at least one support screw attached to each boot flange of the two boxes where the support screw has a blunt end for being positioned flush against a stud or structural element within wall at the frame of a door in which the box is suited for installation; whereby the combination of the boxes with the support screws and cover plate are suited to be installed in a door frame and when installed is very securely attached to the stud or structural element by screws oriented generally perpendicular to one another within the wall at the doorframe and strongly resist force and impacts that are intended to breach the door when closed and locked.

2. The striker box assembly in accordance with claim 1, wherein the support screws are attached to the boot flanges in a manner that allows for adjustment during installation to move into contact with a structural element in the wall, but resists movement relative to the boot flange once the box assembly is installed in a door jamb.

3. The striker box assembly in accordance with claim 2, wherein the support screws have screw threads engaged with screw threads on the boot flange so that rotation of the support screws causes the support screws to move perpendicular to the boot flange and thereby adjust the boxes relative to the jack stud.

4. The striker box assembly in accordance with claim 3, wherein each boot flange includes at least two support screws for being adjusted into contact with the structural element in the wall and spaced apart in the boot flange for a latch to settle fully into each box when the latches are inserted through holes in the face plate.

5. The striker box assembly in accordance with claim 1 wherein the boxes further include a base wing attached to the inner wall at the open front and arranged to extend away from the back wall in the same plane as the top and bottom wings and the face plate is screw attached to the base wing and the back flange is bent to an angle relative to the face plate to form an elongated bend line such that the base wing and the face plate and back flange, with that elongated bend line, combine together to strengthen the striker assembly and resists deformation.

6. The striker box assembly in accordance with claim 1 further including secondary screw holes in each of the cover plate and box that are aligned when the cover plate and box are assembled together for secondary screws to extend through the secondary screw holes to secure the cover plate and box together and the assembly against the stud in the wall.

7. The striker box assembly in accordance with claim 6 further including at least one tertiary screw hole in the cover plate between the two spaced apart holes wherein the tertiary screw hole is for a tertiary screw to extend through the tertiary screw hole to secure the cover plate to the stud in the wall when installed in the door jamb and hold the cover plate to the boxes in the door jamb.

8. An installed striker box assembly for providing a strong, secure striker for a latch of a door locking system, the assembly comprising:

a jack stud in a wall defining one side of a rough door opening;

a door jamb arranged generally along the jack stud wherein the door jamb defines a finished door opening within the rough door opening;

a first box installed in said door jamb at a position to receive a latch from a deadbolt lock;

a second box installed in said door jamb at a position to receive a latch from a doorknob lockset wherein the second box is also positioned in said door jamb spaced below said first box;

each of said first and said second boxes comprise four connected lateral walls where a first lateral wall is an inner wall, a second lateral wall is a back wall that is opposite the inner wall, a third lateral wall is an upper wall and the fourth of the four lateral walls is a lower wall, wherein the four lateral walls of each box are connected end to end to form a generally rectangular shape, each box further having an open front oriented toward the respective latches of the deadbolt and doorknob lockset and a boot flange opposite the open front and attached to at least three of the four connected lateral walls at a bottom of each box and arranged generally perpendicular to all four lateral walls, oriented toward the jack stud and arranged to have firm contact indirectly with the jack stud, at least one primary screw hole is located in the boot flange of each box with a primary screw extending through each of the primary screw holes and into the jack stud to hold the respective box to the jack stud, each box further includes a jack flange attached at or near the bottom of the inner wall and arranged to extend away from the open front of each box beyond the back flange of the box and be flush against the jack stud, at least one jack screw hole is located in each jack flange with a jack screw extending through each jack screw hole and into the jack stud holding the jack flange against the jack stud, wherein the primary screw hole and jack screw hole are also arranged to be generally perpendicular to one another, each box further including an upper wing attached to the respective upper wall at or near the open front of the box and arranged to extend away from the lower wall, a lower wing attached to the lower wall at or near the open front of the box and arranged to extend away from the upper wall and away from the upper wing, wherein the wings are generally arranged to be in a common plane that is generally parallel to the boot flange;

a cover plate attached to the wings of both boxes wherein the cover plate comprises a face plate and a back flange wherein the face plate includes two spaced apart holes wherein a first hole is arranged to overly the open front of the first box and a second hole is arranged to overly the open front of the second box such that the respective latches of the deadbolt and the doorknob lockset extend through the respective holes and into the respective boxes and such that both boxes and the cover plate resist against lateral movement of the latches;

at least one support screw attached to each boot flange of the two boxes where the support screw has a blunt end for being positioned flush against the jack stud to both hold each box away from the jack stud a desired distance so the boxes and cover plate are desirably positioned flush with the door jamb and also so that any force applied to the boxes will be resisted by the support screws in contact with the jack stud; and machine screws holding the cover plate to the boxes, and at least two secondary screws holding the cover plate to the boxes and firmly to the jack stud; whereby the combination of the boxes with the support screws and cover plate installed in the door jamb in contact with the jack stud and screwed to the jack stud using screws that are oriented in at least two generally perpendicular directions is very securely attached to the jack stud and strongly resists force and impacts that are intended to breach the door when closed and locked.

9. The installed striker box assembly in accordance to claim 8 wherein the secondary screws are positioned offline with respect to the primary screws.

10. The installed striker box assembly in accordance with claim 8 wherein the box has a vertical centerline and the primary and secondary screws are positioned on the opposite side of the centerline of the box from the inner wall.

11. The installed striker box assembly in accordance with claim 8, wherein the support screws are attached to the boot flanges in a manner that allows for adjustment to move into contact with the jack stud and then increase or decrease the spacing of the boot flange during installation, but resists movement relative of the boot flanges relative to the jack stud once the striker box assembly is fully installed to the door jamb.

12. The installed striker box assembly in accordance with claim 11, wherein the support screws have screw threads engaged with screw threads on the boot flange so that rotation of the support screws causes the support screws to move perpendicular to the boot flange and thereby adjust the boxes relative to the jack stud.

13. The installed striker box assembly in accordance with claim 12, wherein each boot flange includes at least two support screws for being adjusted into contact with the jack stud and spaced apart within the boot flange for a latch to settle fully into each box when the latches are inserted through holes in the face plate.

14. The installed striker box assembly in accordance with claim 8 wherein the boxes each further include a base wing attached to the inner wall at the open front and arranged to extend away from the back wall in the same plane with the top wing and bottom wing, wherein the face plate is screw attached to the base wing by the machine screws and the back flange is bent to an angle relative to the face plate to form an elongated bend line such that the base wing and the face plate and back flange, with that elongated bend line, combine to strengthen the striker assembly and resist deformation.

15. The installed striker box assembly in accordance with claim 8 further including secondary screw holes in each of the cover plate and boxes that are aligned when the cover plate and boxes are assembled together and secondary screws extending through the secondary screw holes securing the cover plate and boxes together and the assembly against the jack stud.

16. The installed striker box assembly in accordance with claim 15 further including at least one tertiary screw hole in the cover plate between the first and second spaced apart latch holes with at tertiary screw extending through the tertiary screw hole further securing the cover plate to the jack stud to better hold the cover plate to the boxes in the doorjamb.

* * * * *